US009912076B2

(12) United States Patent
Bisiules

(10) Patent No.: US 9,912,076 B2
(45) Date of Patent: Mar. 6, 2018

(54) CHOKED DIPOLE ARM

(71) Applicant: CommScope Technologies, LLC, Hickory, NC (US)

(72) Inventor: Peter J. Bisiules, LaGrange Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 91 days.

(21) Appl. No.: 15/008,951

(22) Filed: Jan. 28, 2016

(65) Prior Publication Data

US 2016/0365645 A1 Dec. 15, 2016

Related U.S. Application Data

(60) Provisional application No. 62/175,587, filed on Jun. 15, 2015.

(51) Int. Cl.

| | |
|---|---|
| ***H01Q 21/26*** | (2006.01) |
| ***H01Q 21/06*** | (2006.01) |
| ***H01Q 1/38*** | (2006.01) |
| ***H01Q 1/52*** | (2006.01) |
| ***H01Q 21/00*** | (2006.01) |

(Continued)

(52) U.S. Cl.

CPC ..... *H01Q 21/062* (2013.01); *H01Q 1/38* (2013.01); *H01Q 1/523* (2013.01); *H01Q 5/321* (2015.01); *H01Q 21/0006* (2013.01); *H01Q 21/26* (2013.01); *H01Q 21/30* (2013.01)

(58) Field of Classification Search

CPC ..... H01Q 21/062; H01Q 1/38; H01Q 5/321; H01Q 1/523

USPC ..... 343/797

See application file for complete search history.

(56) References Cited

U.S. PATENT DOCUMENTS 5,387,919 A * 2/1995 Lam ..... H01Q 9/18 343/795

7,248,227 B2 * 7/2007 Chen ..... H01Q 1/38 343/700 MS (Continued)

FOREIGN PATENT DOCUMENTS

| | | |
|---|---|---|
| DE | 1264541 | 3/1968 |
| GB | 781773 | 8/1957 |

OTHER PUBLICATIONS

International Search Report and Written Opinion for corresponding PCT Application No. PCT/US2016/015350, dated May 24, 2016, 15 pages.

*Primary Examiner* — Huedung Mancuso

(74) *Attorney, Agent, or Firm* — Myers Bigel, P.A.

(57) ABSTRACT

A low band radiator for a dual band antenna having a low band and a high band. The radiator includes a dipole arm having a center conductor and at least one RF choke including at least one partial box section closed at one end and open at the other end and having two opposing sides, a bottom and an open top. The closed end is shorted to the center conductor and the partial box section is quasi-coaxial with center conductor. The choke is resonant near the frequency of the high band of the antenna. The dipole arm may include a plurality of the partial box sections with a gap between each section to form a plurality of RF chokes. The dipole arm may be fabricated as a single die cast metal piece or as a plastic injection molded piece plated with conductive material.

20 Claims, 6 Drawing Sheets

(51) Int. Cl.
*H01Q 21/30* (2006.01)
*H01Q 5/321* (2015.01)

(56) References Cited

U.S. PATENT DOCUMENTS

| | | | | |
|---|---|---|---|---|
| 2010/0283699 | A1* | 11/2010 | Apostolos | H01Q 1/3275 343/792 |
| 2011/0175782 | A1* | 7/2011 | Choi | H01Q 1/246 343/798 |
| 2015/0214617 | A1 | 7/2015 | Sang et al. | |
| 2015/0303564 | A1 | 10/2015 | Payne et al. | |

* cited by examiner

CHOKED DIPOLE ARM

This application claims priority to the following U.S. Provisional Application pursuant to 35 U.S.C. § 120, U.S. Provisional Application Ser. No. 62/175,587 filed Jun. 15, 2015. The disclosure of this application is incorporated by reference.

BACKGROUND

The present inventions relate generally to wireless communications antenna systems. In particular, they relate to improvements in dipole arms in multi-band wireless base station antennas.

Developments in wireless technology typically require wireless operators to deploy new antenna equipment in their networks. Disadvantageously, towers have become cluttered with multiple antennas while installation and maintenance have become more complicated. Basestation antennas typically covered a single narrow band. This has resulted in a plethora of antennas being installed at a site. Local governments have imposed restrictions and made getting approval for new sites difficult due to the visual pollution of so many antennas. Some antenna designs have attempted to combine two bands and extend bandwidth, but still many antennas are required due to the proliferation of many air-interface standards and bands.

Ultra-wideband dual-band dual-polarization cellular basestation antennas have been developed. In such ultra wide band antennas, low band elements are interspersed with high band elements. However, low band elements have been observed to distort RF radiation patterns of the high band elements. International Pat. Pub. No. WO 2014100938 A1 ("'938 Application"), titled Dual-band Interspersed Cellular Basestation Antennas, the disclosure of which is incorporated by reference, provides a solution where the low band radiators have dipole arms comprising at least two dipole segments and at least one radiofrequency (RF) choke. The choke is disposed between the dipole segments. Each choke provides an open circuit or high impedance separating adjacent dipole segments to minimize induced high band currents in the low-band radiator and consequent disturbance to the high band pattern. The choke is resonant at or near the frequencies of the high band.

In the '938 Application, each dipole segment comprises an electrically conducting elongated body; the elongated body is open circuited at one end and short circuited at the other end to a center conductor. The electrically conducting elongated body may be cylindrical or tubular in form, and the center conductor connects the short circuited portions of the dipole segments, forming a coaxial choke. Each choke may have a length of a quarter wavelength ($\lambda/4$) or less at frequencies in the bandwidth of the high band.

While effective, the choked dipole arms of the '938 Application require multiple manufacturing steps. Each conducting, elongated body is manufactured separately, and affixed to a machined rod center conductor. The rod is machined down where it is not interfacing with a conducting elongated body. Also, each interface between the rod and a conducting elongated body presents a potential for an imperfect ohmic contact, resulting in Passive Intermodulation (PIM).

SUMMARY OF THE INVENTION

A low band radiator for a dual-band antenna according to one aspect of the invention includes a at least one choked dipole arm having a center conductor and at least one RF choke quasi-coaxial about the center conductor comprising a partial box section closed at one end and open at another end and having two opposing sides, a bottom and an open top. The closed end is short circuited to the center conductor and the RF choke is resonant at a frequency near the high band frequency. The dipole arm may include a plurality of the partial box sections each of which are separated from each other by a gap to form a plurality of RF chokes. The dipole arm may be manufactured as a single die cast metal piece or as an injection molded plastic piece plated with conductive material.

DESCRIPTION OF EXAMPLES OF THE INVENTION

The present invention is described herein with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Many different embodiments are disclosed herein, in connection with the description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and sub combinations of the embodiments described herein, and of the manner and process of making and using them, and shall support claims to any such combination or subcombination.

Figure 1:
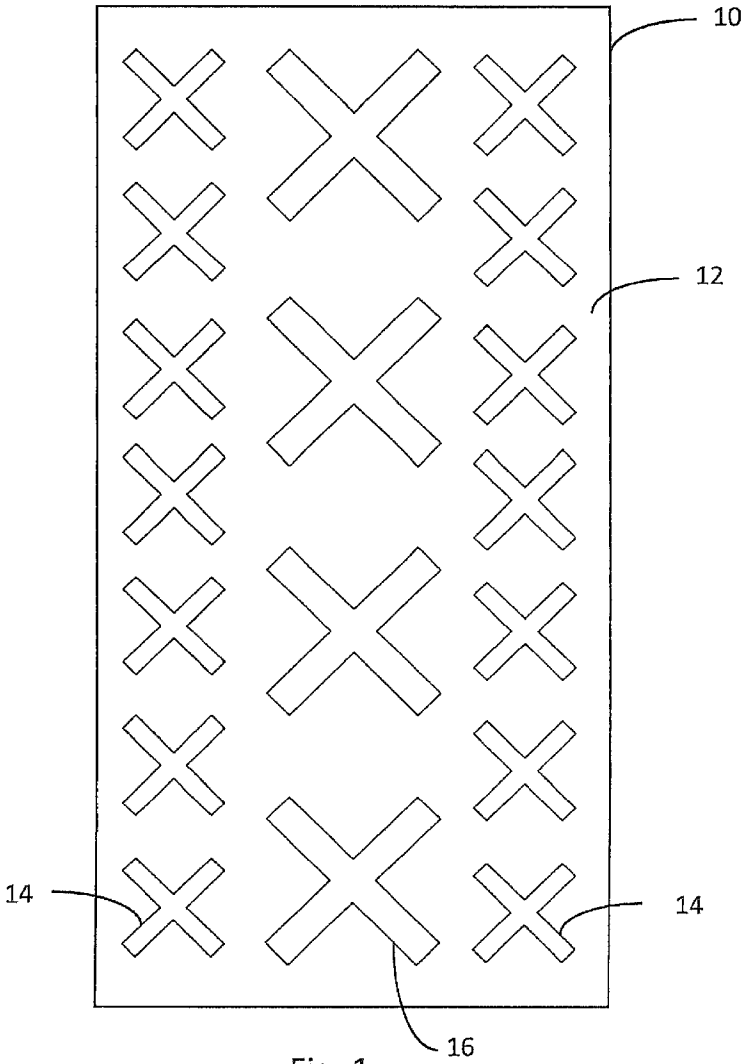
FIG. 1 is a schematic diagram of a first example of a wide-band, dual-band antenna assembly according to one embodiment.

FIG. 1 schematically diagrams an example embodiment of a dual-band antenna 10. The dual band antenna 10 includes a reflector 12, an array of high band radiating elements 14 and an array of low band radiating elements 16. Multiband radiating arrays of this type often include vertical columns of high band and low band elements, as shown, spaced at about one-half wavelength intervals.

Figure 2:
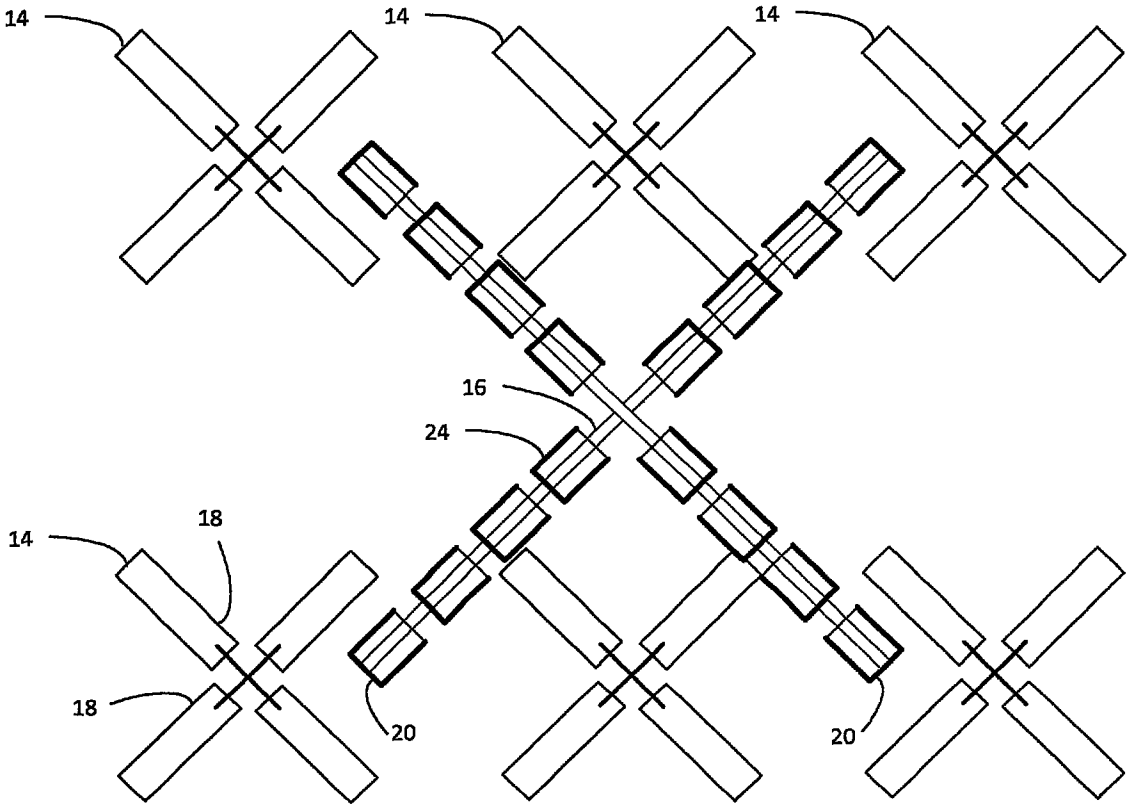
FIG. 2 is a schematic diagram of a portion of the wide-band, dual band example antenna of FIG. 1.

FIG. 2 schematically illustrates a portion of an ultra-wide band dual band antenna 10. The high band radiating element 14 is a crossed dipole element which includes first and second dipole arms 18. The low band radiating element 16 also comprises a crossed dipole element, and includes first and second dipole arms 20. In this example, each dipole arm 20 is approximately one-half wavelength long at the low band operating frequency and includes a plurality of segments 24 comprising RF chokes.

The choked dipole low band radiating element may be advantageously used in an ultra-wideband dual-band dual-polarization cellular base-station antenna. The dual bands are low and high bands suitable for cellular communications. The dual-band antenna comprises: at least one low-band radiator with choked dipole arms as set forth herein, and a number of high band radiators each adapted for dual polarization, the high band radiators being configured in at least one array, the low-band radiators being interspersed amongst the high band radiators at predetermined intervals.

As used herein, "low band" refers to a lower frequency band, such as 698-960 MHz, and "high band" refers to a higher frequency band, such as 1695 MHz-2690 MHz. A "low band radiator" refers to a radiator for such a lower frequency band, and a "high band radiator" refers to a radiator for such a higher frequency band. The "dual band" comprises the low and high bands referred to throughout this disclosure. Further, "ultra-wideband" with reference to an antenna connotes that the antenna is capable of operating and maintaining its desired characteristics over a bandwidth of at least 30%. Characteristics of particular interest are the beam width and shape and the return loss, which needs to be maintained at a level of at least 15 dB across this band. In the present instance, the ultra-wideband dual-band antenna covers the bands 698-960 MHz and 1695 MHz-2690 MHz. This covers almost the entire bandwidth assigned for all major cellular systems.

The embodiments of the invention relate generally to low-band radiators of an ultra-wideband dual-band dual-polarization cellular basestation antenna and such dual-band cellular base-station antennas adapted to support emerging network technologies. Such ultra-wideband dual-band dual-polarization antennas enable operators of cellular systems ("wireless operators") to use a single type of antenna covering a large number of bands, where multiple antennas were previously required. Such antennas are capable of supporting several major air-interface standards in almost all the assigned cellular frequency bands and allow wireless operators to reduce the number of antennas in their networks, lowering tower leasing costs while increasing speed to market capability. Ultra-wideband dual-band dual-polarization cellular basestation antennas support multiple frequency bands and technology standards. For example, wireless operators can deploy using a single antenna Long Term Evolution (LTE) network for wireless communications in 2.6 GHz and 700 MHz, while supporting Wideband Code Division Multiple Access (W-CDMA) network in 2.1 GHz. For ease of description, the antenna array is considered to be aligned vertically.

In an interspersed design, typically the low-band radiators are located on an equally spaced grid appropriate to the frequency and then the low-band radiators are placed at intervals that are an integral number of high-band radiators intervals—often two such intervals and the low-band radiator occupies gaps between the high-band radiators. The high-band radiators are normally dual-slant polarized and the low-band radiators are normally dual polarized and may be either vertically and horizontally polarized, or dual slant polarized.

A principal challenge in the design of such ultra-wideband dual-band antennas is minimizing the effect of scattering of the signal at one band by the radiating elements of the other band. The embodiments of the invention aim to minimize the effect of the low-band radiator on the radiation from the high-band radiators. This scattering affects the shapes of the high-band beam in both azimuth and elevation cuts and varies greatly with frequency. In azimuth, typically the beamwidth, beam shape, pointing angle, gain, and front-to-back ratio are all affected and vary with frequency in an undesirable way. Because of the periodicity in the array introduced by the low-band radiators, a quantization lobe is introduced into the elevation pattern at angles corresponding to the periodicity. This also varies with frequency and reduces gain. With narrow band antennas, the effects of this scattering can be compensated to some extent in various ways, such as adjusting beamwidth by offsetting the high-band radiators in opposite directions or adding directors to the high-band radiators. Where wideband coverage is required, correcting these effects is significantly more difficult.

The embodiments of the invention reduce the induced current at the high band on the low-band radiating elements by introducing one or more RF chokes that are resonant at or near the frequencies of the high band. Thus, the use of one or more chokes is advantageous in the dipole arms, as described hereinafter. When multiple chokes are used they may be the same length or they may be slightly different lengths in order to resonate at different frequencies in or near the frequency of the high band. As shown in the drawings, the RF chokes are quasi coaxial chokes, being gaps about a center conductor between partial box-shaped conducting bodies. However, the chokes may be practiced otherwise.

One advantage of this choked configuration is that an integer ratio (e.g. 2:1) between low and high band radiator element spacing is not required because of the reduced interference of the low band dipoles on the high band radiating pattern due to the chokes on the dipole arms. Thus, the ratio of element spacing may be any suitable ratio (e.g. 2.5:1, 1.7:1, etc.) to get the desired high band and low band spacings to eliminate or reduce the presence of quantization lobes while not forcing the element spacing to be so close as to cause coupling issues that degrade isolation within a band or cause increased cost of the antenna.

Figure 3:
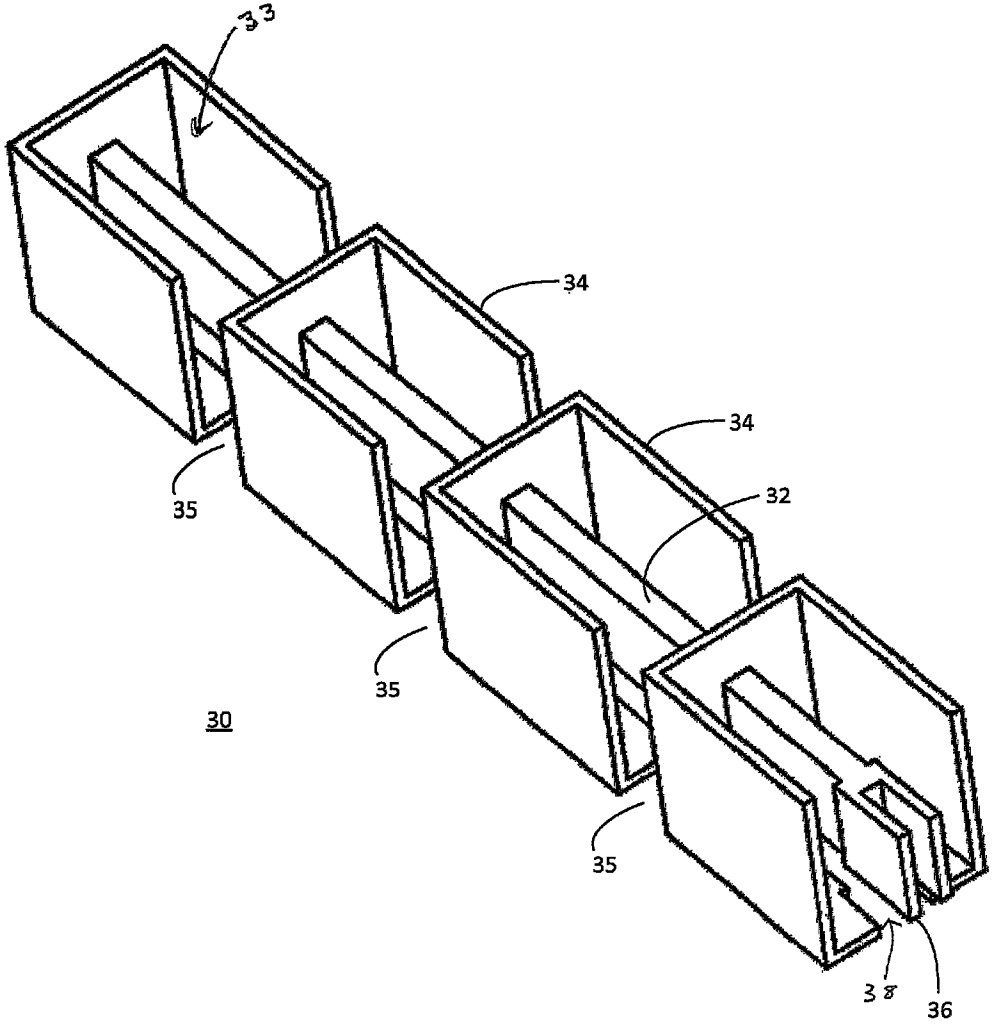
FIG. 3 is a detailed isometric view illustrating an example of a dipole arm with a single piece die cast conductive metal choked dipole arm adapted for use in the example of FIGS. 1 and 2.
Figure 4:
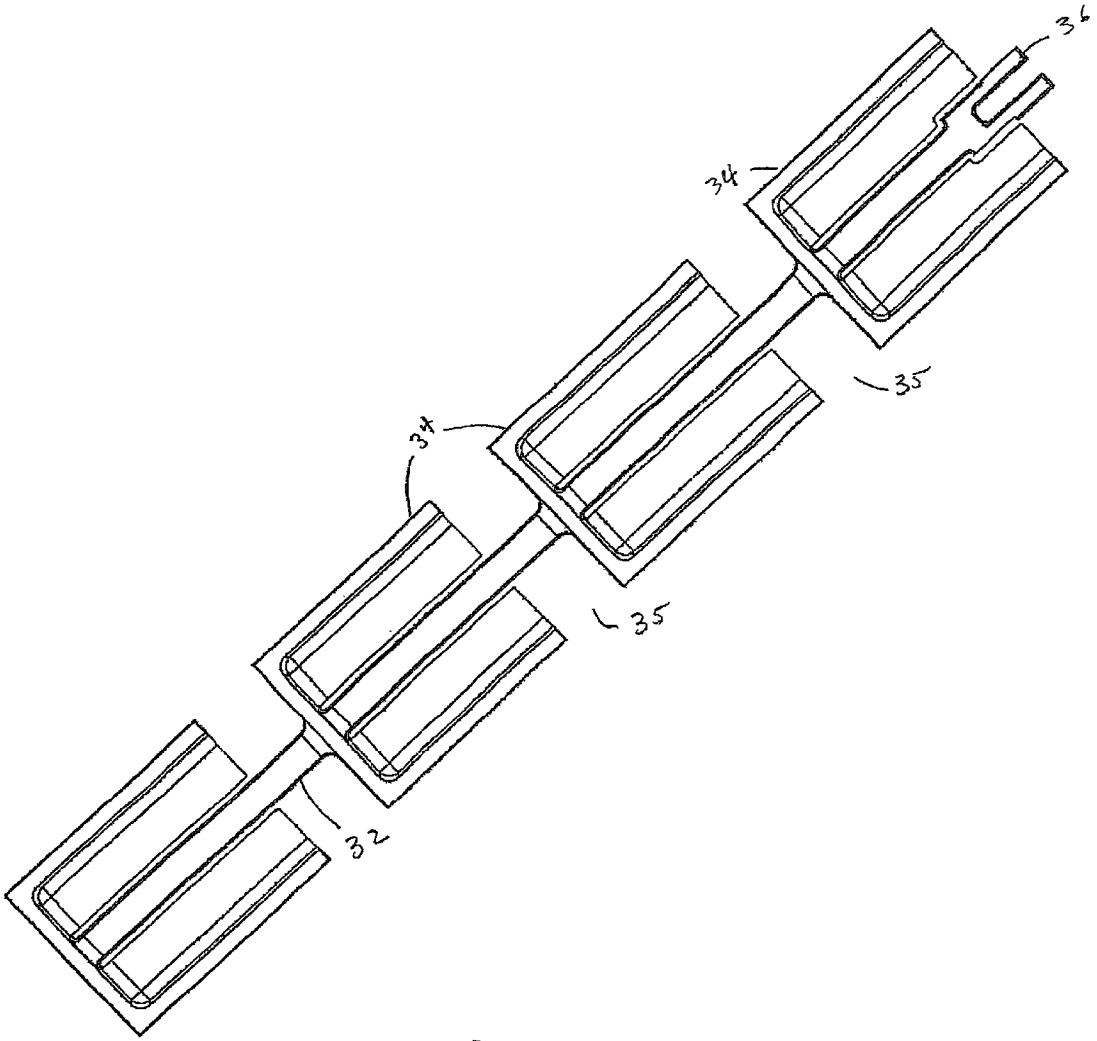
FIG. 4 is a top view of the example choked dipole arm of FIG. 3.

Referring to FIGS. 3-6, a single piece, die cast conductive metal choked dipole arm 30 is provided. FIG. 3 is an isometric view of the choked dipole arm 30, and FIG. 4 is a top view of the choked dipole arm 30. The dipole arm 30 may be employed with a low band radiating element 16 as illustrated as dipole arm 20 in FIG. 2. The dipole arm 30 comprises a center conductor 32 and a plurality of partial box sections 34 separated by gaps 35. The center conductor 32 in some embodiments may have a rectangular cross section or may have a round cross-section (i.e., circular or elliptical). An RF choke comprises a partial box section 34, a gap 35 and other associated portion of center conductor 32. The partial box sections 34 are closed at one end and open at the other end. The closed box end is shorted to the center conductor 32. The partial box sections 34 also may comprise two opposing sides and a bottom, as shown. The top is open. In some embodiments, the partial box may be rounded at the edges.

Figure 5:
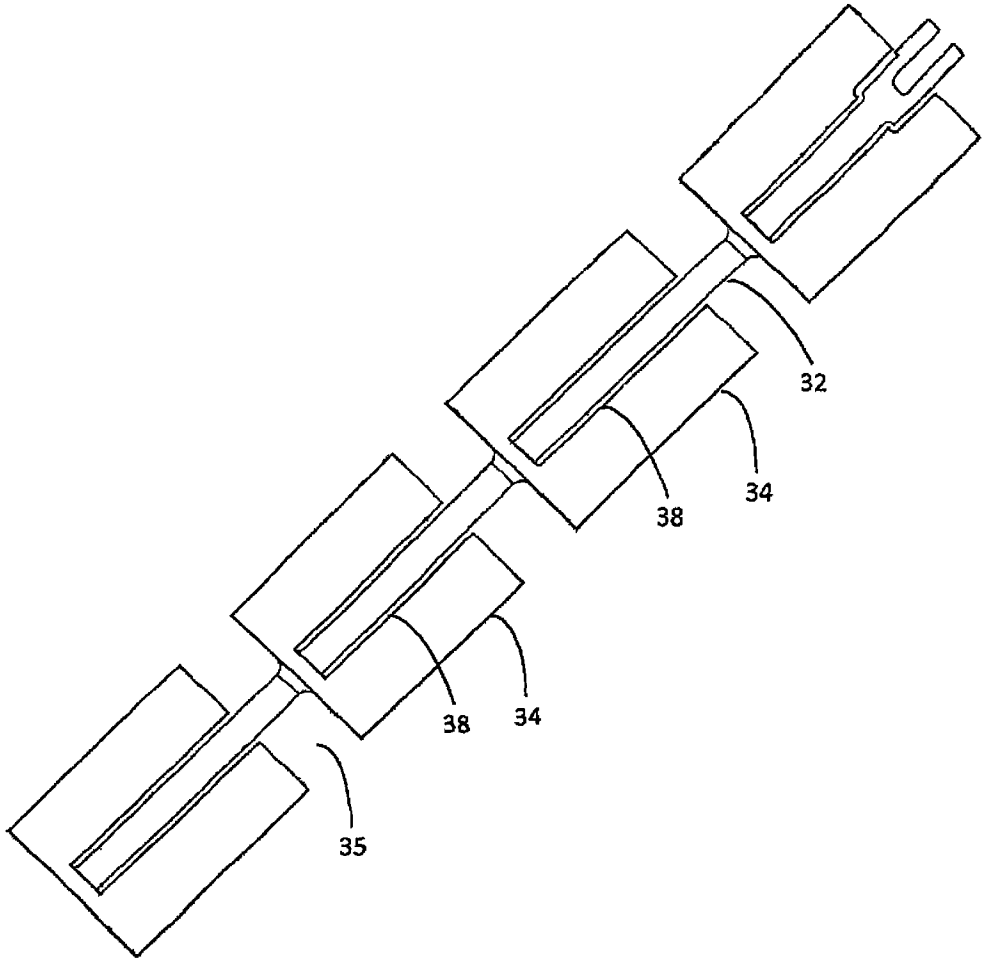
FIG. 5 is a bottom view of the choked dipole arm of the example of FIG. 3, including a cut-away view adapted for use in the first example of the present invention.
Figure 6:
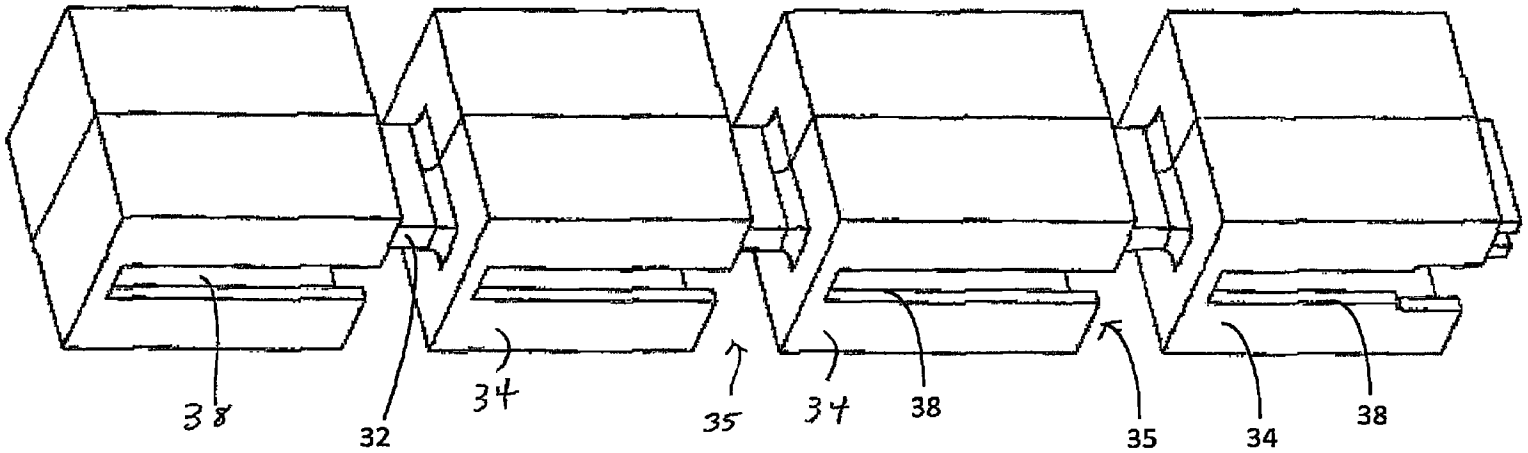
FIG. 6 is an alternative view of the bottom and side of the example choked dipole arm of FIGS. 3-5.

FIG. 5 provides a bottom view of the choked dipole arm 30, and FIG. 6 provides an alternate view of the bottom and a side of the choked dipole arm 30. Referring to FIGS. 5 and 6, slots 38 may be provided on the bottom of the box section 34 to facilitate using a two piece mold for diecasting. Each slot 38 is slightly wider than the center conductor 32. The slots 38 allows for the center conductor 32 to be fabricated using a two piece diecasting mold. Optionally, the slots 38 may be covered after die-casting by a conductive material, for example, by metallic tape. Alternatively to diecasting, the choked dipole arms may be fabricated using injection-molded plastic techniques and then plating the plastic molded components with metal. Other methods may also be used to fabricate the choked dipole arms to form them as one-piece conductive parts including, but not limited to, metal injection molding, 3-D printing with a conductive material, and semi-solid metal casting (e.g. thixomolding).

In the illustrated example the dipole arm may comprise four RF chokes, e.g., four partial box sections 34 disposed on center conductor 32 separated by three gaps 35. Greater or fewer RF chokes may be employed, and the length of each choke section may be varied as a means to improve wide band performance. The center conductor 32 may have a thickness adapted to provide immunity from disturbance of the high-band radiation pattern by the low-band radiator over the entire high-band bandwidth.

This configuration allows the choked dipole arm of the present invention to be die cast or otherwise formed in a mold. The result is a one-piece, quasi coaxial choked dipole arm that is more cost effective to manufacture than a true coaxial choked dipole arm, and does not contain metal to metal interfaces which may result in PIM.

In one example, the choked dipole arm may comprise an anti-resonant dipole arm. An anti-resonant dipole arm is approximately one-half-wavelength (or a little less than one-half wavelength) in length of a frequency in the low band. The embodiments of the invention are particularly effective when the choked dipole arm is less than one-half wavelength of a center frequency of the low band, but longer than a conventional quarter-wavelength resonant dipole arm, such that the combination of two dipole arms has a length between three-quarters and one full wavelength at the operating frequency band.

In the illustrated example, the center conductor terminates in a fork 36. The fork is dimensioned to allow a printed circuit board (PCB) feed board to be inserted in the fork, and to have sufficient area to capacitively couple the dipole arm to a feed circuit on the feed board. This fork shaped slot, while shown in its simplest form, can be adjusted to improve the tolerance on the capacitive coupling as well as to optimize the fit to the mating PCB. Preferably, an inductive section is also included on the PCB to tune out the capacitance and form an LC coupling circuit.

Each RF choke provides an open circuit or a high impedance separating adjacent dipole segments to minimize induced high band currents in the low-band radiator and consequent disturbance to the high band pattern. The RF choke is resonant at or near the frequencies of the high band. Adding high-band chokes to anti-resonant low band dipole arms has been found to reduce undesirable effects caused by scattering described above. For example, the grating lobe or quantization lobe is reduced, and there is a reduction in variation of pointing, and improvement in front-to back ratio, and stability of azimuth beamwidth.

The low-band radiator comprises crossed dipoles for +/−45 degree dual polarization with crossed center feed. Center feed comprises two interlocked, crossed printed circuit boards (PCB) having feeds formed on respective PCBs for dipoles. The antenna feed may be a balun, of a configuration well known to those skilled in the art. The center feed suspends the low band dipoles above a metal groundplane, by preferably a quarter wavelength.

While a specific implementation of the dipole arm with four dipole segments is illustrated, the embodiments of the invention are not so limited. Other numbers of dipole segments and related RF chokes may be practiced without departing from the scope of the invention. For example, the dipole arm 30 may comprise at least two partial box sections 34. Adjacent choke sections are spaced apart about the center conductor 32 so that there is a gap 35 between the adjacent partial box sections 34. The dimensions of the components of the chokes are such as to place the resonance of the RF choke in the high band.

The center conductor 32 may be an elongated rectangular conducting body. The thickness of the center conductor influences the bandwidth of the choke and may be adapted to minimize the high-band current over the whole of the high band thereby providing immunity from disturbance of the high-band radiation pattern by the low-band radiator over the entire high-band bandwidth.

The space 33 between the partial box sections 34 and the center conductor 32 may be filled with air, as depicted in FIG. 3. Alternatively, the space 33 between the partial box sections 34 and the center conductor 32 may be filled or partly filled with dielectric material.

Thus, low-band radiators of an ultra-wideband dual-band dual-polarization cellular basestation antenna and such dual-band cellular base-station antennas described herein and/or shown in the drawings are presented by way of example only and are not limiting as to the scope of the invention. Unless otherwise specifically stated, individual aspects and components of the hybrids may be modified, or may have been substituted therefore known equivalents, or as yet unknown substitutes such as may be developed in the future or such as may be found to be acceptable substitutes in the future.

Although embodiments of the present invention have been described with reference to specific example embodiments, it will be evident that various modifications and changes may be made to these embodiments without departing from the broader spirit and scope of the invention. Accordingly, the specification and drawings are to be regarded in an illustrative rather than a restrictive sense and it is intended that the invention be limited only to the extent required by the appended claims and the applicable rules of law.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

What is claimed is:

1. A low band radiator for a dual band antenna having a low frequency band and a high frequency band, wherein the low band radiator comprises a choked dipole arm having an elongated center conductor, and wherein the choked dipole arm further comprises:

at least one radio frequency choke comprising a partial box section that is closed on a first end, open on a second end parallel to the first end, and that comprises a bottom that is perpendicular to the first and second ends and that has a slot, wherein the first end is short circuited to the elongated center conductor, wherein the partial box section is quasi-coaxial about the elongated center conductor, and wherein the at least one radio frequency choke is resonant near the high frequency band.

2. The low band radiator of claim 1, wherein the at least one radio frequency choke comprises a plurality of radio frequency chokes, wherein each radio frequency choke of the plurality of radio frequency chokes has a partial box section, and wherein each partial box section is separated by a gap.

3. The low band radiator of claim 2 wherein the elongated-center conductor has a rectangular cross-section.

4. The low band radiator of claim 3 wherein the choked dipole arm is formed as a single conductive piece.

5. The low hand radiator of claim 4, wherein the slot in each bottom of the plurality of the radio frequency chokes facilitates use of a two piece-mold for die casting the choked dipole arm.

6. The low band radiator of claim 1 wherein the slot is wider than the elongated center conductor.

7. The low band radiator of claim 1 further comprising a conductive covering that covers the slot.

8. The low band radiator of claim 2 wherein the choked dipole arm comprises injection-molded plastic and metal plating.

9. The low band radiator of claim 2 wherein the choked dipole arm comprises four partial box sections separated by three gaps.

10. The low band radiator of claim 1 wherein the choked dipole arm is less in length than one-half wavelength of a center frequency of the low frequency band.

11. The low band radiator of claim 2 wherein the elongated center conductor terminates in a fork that is dimensioned to allow a printed circuit board to be inserted into the fork and dimensioned to capacitively couple the choked dipole arm to a feed circuit on the printed circuit board.

12. The low band radiator of claim 11 wherein an inductor section configured to tune out the capacitance is included on the printed circuit board.

13. The low band radiator of claim 2 wherein each radio frequency choke of the plurality of radio frequency chokes provides a high impedance separating adjacent section.

14. The low band radiator of claim 1, wherein the choked dipole arm is a first choked dipole arm, the low band radiator further comprising a second choked dipole arm.

15. The low band radiator of claim 1 wherein the partial box section is at least partially filled with dielectric material.

16. The low band radiator of claim 2 wherein the elongated center conductor connects first ends of the partial box sections of the plurality of radio frequency chokes.

17. The low band radiator of claim 2 wherein the elongated center conductor has a thickness adapted to minimize high frequency hand current to reduce disturbances of high-band radiation patterns by the low band radiator.

18. The low band radiator of claim 2 wherein the choked dipole arm is fabricated as a one piece choked dipole arm without metal to metal interfaces.

19. The low band radiator of claim 2 wherein the radio frequency chokes of the plurality of radio frequency chokes are of different lengths.

20. The low band radiator of claim 1, wherein the elongated center conductor has a round cross-section.

* * * * *